US009741314B2

(12) United States Patent
Kikuchi et al.

(10) Patent No.: US 9,741,314 B2
(45) Date of Patent: Aug. 22, 2017

(54) IMAGE DATA PROCESSING CIRCUIT AND DISPLAY SYSTEM

(71) Applicant: Saturn Licensing LLC, New York, NY (US)

(72) Inventors: Hidekazu Kikuchi, Kanagawa (JP); Takayuki Mogi, Kanagawa (JP); Atsuhiro Naka, Kanagawa (JP); Hiroshi Iizuka, Kanagawa (JP)

(73) Assignee: Saturn Licensing LLC, New York, NY (US)

( * ) Notice: Subject to any disclaimer, the term of this patent is extended or adjusted under 35 U.S.C. 154(b) by 276 days.

(21) Appl. No.: 13/955,667

(22) Filed: Jul. 31, 2013

(65) Prior Publication Data

US 2014/0055473 A1 Feb. 27, 2014

(30) Foreign Application Priority Data

Aug. 27, 2012 (JP) ..... 2012-186727

(51) Int. Cl.

| | |
|---|---|
| ***G09G 5/02*** | (2006.01) |
| ***G09G 5/393*** | (2006.01) |
| ***G09G 5/18*** | (2006.01) |

(52) U.S. Cl.

CPC ..... *G09G 5/022* (2013.01); *G09G 5/393* (2013.01); *G09G 5/18* (2013.01); *G09G 2320/0666* (2013.01); *G09G 2320/0686* (2013.01); *G09G 2320/103* (2013.01); *G09G 2340/16* (2013.01); *G09G 2360/18* (2013.01)

(58) Field of Classification Search

CPC ..... G09G 5/022

See application file for complete search history.

(56) References Cited

U.S. PATENT DOCUMENTS 5,838,310 A * 11/1998 Uya ..... H04N 9/75 345/536
7,142,218 B2 11/2006 Yoshida et al.
2004/0119726 A1* 6/2004 Li ..... 345/629

(Continued)

FOREIGN PATENT DOCUMENTS

CN 1324066 A 11/2001
CN 1804989 A 7/2006

(Continued)

OTHER PUBLICATIONS

Chinese Office Action issued Aug. 26, 2016 for corresponding Chinese Application No. 2013103649226.

*Primary Examiner* — Kee M Tung
*Assistant Examiner* — Grace Q Li
(74) *Attorney, Agent, or Firm* — Michael Best & Friedrich LLP

(57) ABSTRACT

There is an image data processing circuit including a memory storing input image data, the input image data being limited to a specific number of colors or to a specific image range, and a correction processing part replacing, when a predetermined tone change is present between a pixel in image data previous by one frame whose data is stored by the memory and a pixel in image data in a current frame whose data is input, a relevant pixel in the current frame with a color of a specific tone. The memory is built in an integrated circuit included in the correction processing part.

16 Claims, 12 Drawing Sheets

(56) References Cited

U.S. PATENT DOCUMENTS

| | | | | |
|---|---|---|---|---|
| 2005/0105608 | A1* | 5/2005 | Coleman | G06F 3/1454 375/240.01 |
| 2005/0243347 | A1* | 11/2005 | Hayaishi | 358/1.9 |
| 2006/0152463 | A1* | 7/2006 | Furihata et al. | 345/98 |
| 2008/0304745 | A1* | 12/2008 | Honma | 382/173 |
| 2009/0079870 | A1* | 3/2009 | Matsui | G09G 5/008 348/558 |
| 2011/0102478 | A1* | 5/2011 | Huang | G09G 3/2003 345/690 |
| 2012/0327488 | A1* | 12/2012 | Ito | H04N 1/62 358/530 |

FOREIGN PATENT DOCUMENTS

| | | | |
|---|---|---|---|
| CN | 101178875 | A | 5/2008 |
| CN | 101321222 | A | 12/2008 |
| JP | 2005-107491 | | 4/2005 |
| JP | 2008-139842 | A | 6/2008 |

* cited by examiner

FIG. 5

| PIXEL DATA (24 BITS) | DATA EFFECTIVE | COLOR CODE DATA (4 BITS) |
|---|---|---|
| X | 0 | 0000 |
| FFFFFF | 1 | 0001 |
| 0080FF | 1 | 0010 |
| 4000FF | 1 | 0011 |
| 000080 | 1 | 0100 |
| FFFF00 | 1 | 0101 |
| C04080 | 1 | 0110 |
| : | 1 | 0111 |
| : | 1 | 1000 |
| : | 1 | 1001 |
| : | : | : |
| : | 1 | 1111 |

FIG. 6

| 0 | 1 | 2 | 3 | ··· | 1919 |
|---|---|---|---|---|---|
| 1920 | 1921 | 1922 | 1923 | ··· | 3839 |
| : | : | : | : | | : |
| 2071680 | 2071681 | 2071682 | 2071683 | ··· | 2073599 |

IMAGE DATA PROCESSING CIRCUIT AND DISPLAY SYSTEM

BACKGROUND

The present disclosure relates to a display system using a liquid crystal display panel and an image data processing circuit used for the display system.

From among technologies applied for driving a liquid crystal display panel for image display, known is an overdrive technology of improving poor response in color change of pixels.

Namely, a liquid crystal display panel, for example, included in a television receiver refreshes a display image in a frame cycle such as 1/60 sec. One sixtieth seconds corresponds to approximately 16 msec. Herein, when a display color of a pixel in the liquid crystal display panel changes from a specific display color to another display color, there is sometimes a case where the color change takes place with a delay later than 16 msec due to relationship between the tones of the two display colors. Such a delay in color change causes an afterimage in the liquid crystal display panel which is not in an image to be displayed by nature, this deteriorating quality of the display image.

Here, the overdrive technology is a technology of changing color change (tone change) to be delayed later than the frame cycle to tone change for compensating the delay, preventing such an afterimage from arising. The tone change to be delayed later than the frame cycle is determined from tone change status of each pixel by referring to a beforehand prepared table. In case of determination of the tone change to be delayed later than the frame cycle, an overdrive circuit performs correction of the relevant pixel from the color by nature to a color with a tone stored in the table. Or the overdrive circuit prepares a calculation formula for calculating a correction value and obtains a tone corrected from the calculation formula using two tones of a tone in the current frame tone and a tone in the previous frame. The overdrive circuit obtains color data for the corrected tone, this attaining display in which an afterimage is suppressed.

Japanese Patent Laid-Open No. 2005-107491 discloses a liquid crystal display apparatus capable of improving a response rate of the display image by the overdrive.

SUMMARY

Incidentally, in order to perform the overdrive, the overdrive circuit should store pixel signals previous by one frame for all the pixels displayed by the liquid crystal display panel. Furthermore, the overdrive circuit compares the current pixel signals with the stored pixel signals previous by one frame to perform correction on the tone of each pixel based on the comparison results. The circuit performing such processing has a relatively large-scale circuit configuration for handling a pixel number for one frame, this leading to increased manufacturing costs of the display apparatus.

For example, supposed that the pixel number for one frame is 1920 in the horizontal direction×1080 in the vertical direction and the data of each pixel has every 8 bits for each color of red R, green G and blue B, the capacity of a frame memory for storing all the pixels for one frame is approximately 50 Mbits. The overdrive circuit expecting such a large capacity memory has a complex circuit configuration, this causing increased manufacturing costs.

It is desirable to attain a simple configuration for a display system and an image data processing circuit performing overdrive processing for afterimage suppression.

According to the embodiment of the present disclosure, there is provided a display system including an image data generation part generating image data for display in a frame cycle, a correction processing part correcting the image data generated by the image data generation part, and a driving part driving a display panel, based on the image data corrected by the correction processing part.

A memory stores the image data generated by the image data generation part, the image data being limited to a specific number of colors or to a specific image range. Then, the correction processing part detects tone difference between a pixel in image data previous by one frame whose data is stored by the memory and a pixel in image data in a current frame whose data is generated by the image data generation part. Moreover, when the comparison thereof indicates a predetermined tone change, the correction processing part replaces the relevant pixel in the current frame with a color of a specific tone.

According to the embodiment of the present disclosure, there is provided an image data processing circuit including a memory storing input image data, and a correction processing part correcting the input image data.

The memory stores the image data, the image data being limited to a specific number of colors or to a specific image range. The correction processing part detects tone difference between a pixel in image data previous by one frame whose data is stored by the memory and a pixel in image data in a current frame. Then, when the comparison thereof indicates a predetermined tone change, the correction processing part replaces a relevant pixel in the current frame with a color of a specific tone.

According to the embodiment of the present disclosure, the memory stores the image data, the image data being limited to a specific number of colors or to a specific image range, the data amount thereof being reduced. Accordingly, the memory can employ one with a decreased storage capacity which is less than the data amount of the input image data for one frame.

According to the embodiment of the present disclosure, a frame memory expected for overdrive processing can employ one with a decreased storage capacity which less than the data amount of original image data for one frame. Therefore, an image data processing circuit can be implemented with a simple configuration using a memory with a decrease storage capacity.

BRIEF DESCRIPTION OF THE DRAWINGS

FIG. 5 is a diagram illustrating an example of stored data and addresses according to the first embodiment of the present disclosure;

FIG. 6 is a diagram illustrating an example of pixel addresses according to the first embodiment of the present disclosure;

DETAILED DESCRIPTION OF THE EMBODIMENT(S)

Figure 1:
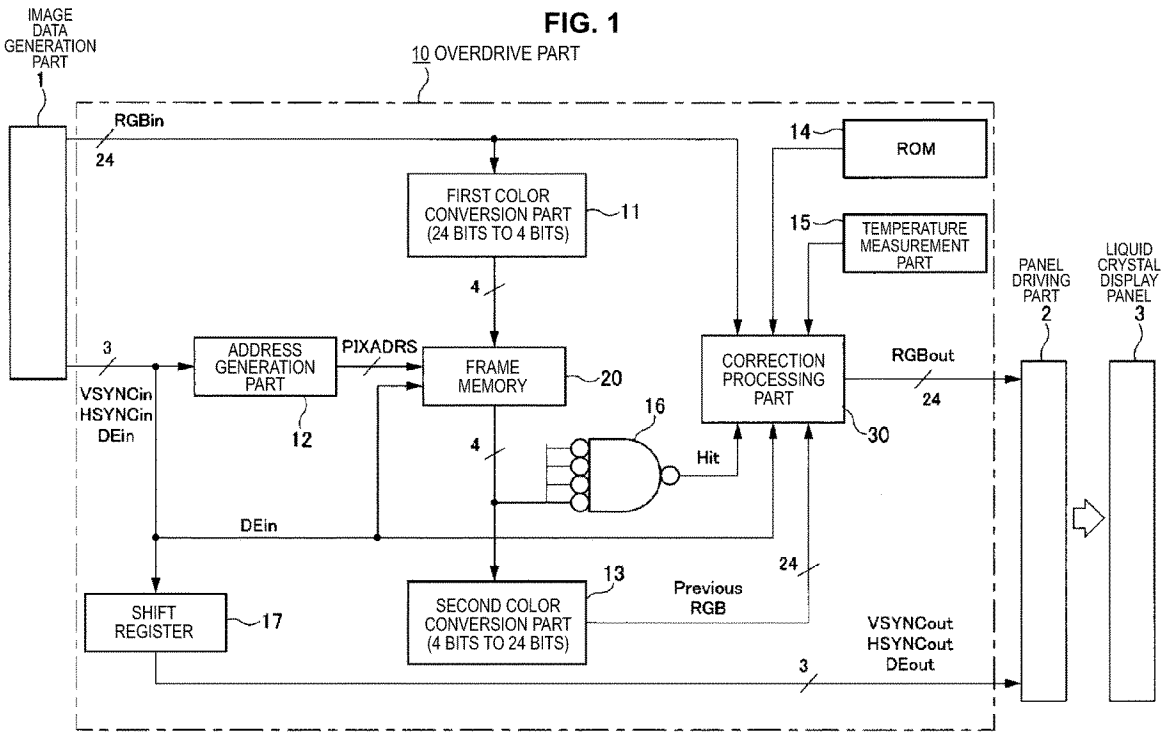
FIG. 1 is a block diagram illustrating an entire exemplary configuration according to a first embodiment according to an embodiment of the present disclosure.
Figure 2:
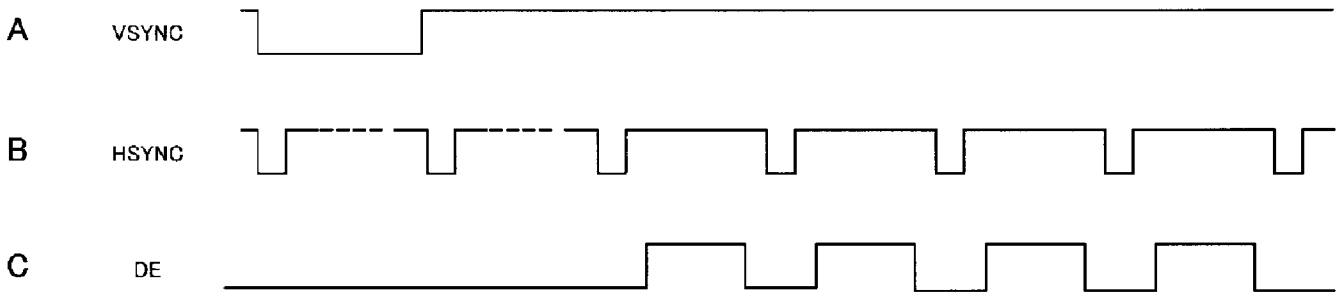
FIGS. 2A to 2C are waveform diagrams illustrating an example of synchronization data according to the first embodiment of the present disclosure.

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

Examples of a display system and an image data processing circuit according to the embodiments of the present disclosure are described in the following order, referring to the drawings.

1-1. Entire Configuration According to First Embodiment (FIG. 1 and FIGS. 2A to 2C)

Figure 3:
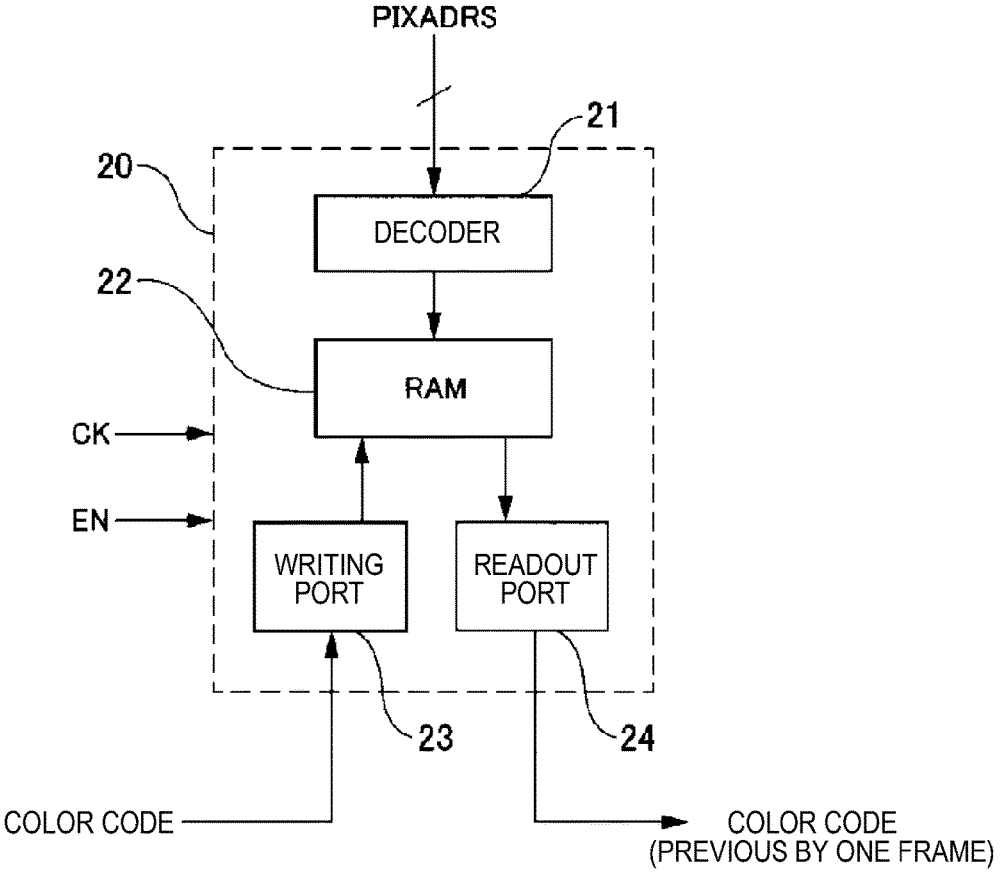
FIG. 3 is a block diagram illustrating an example of a frame memory according to the first embodiment of the present disclosure.

1-2. Frame Memory Configuration According to First Embodiment (FIG. 3)

Figure 4:
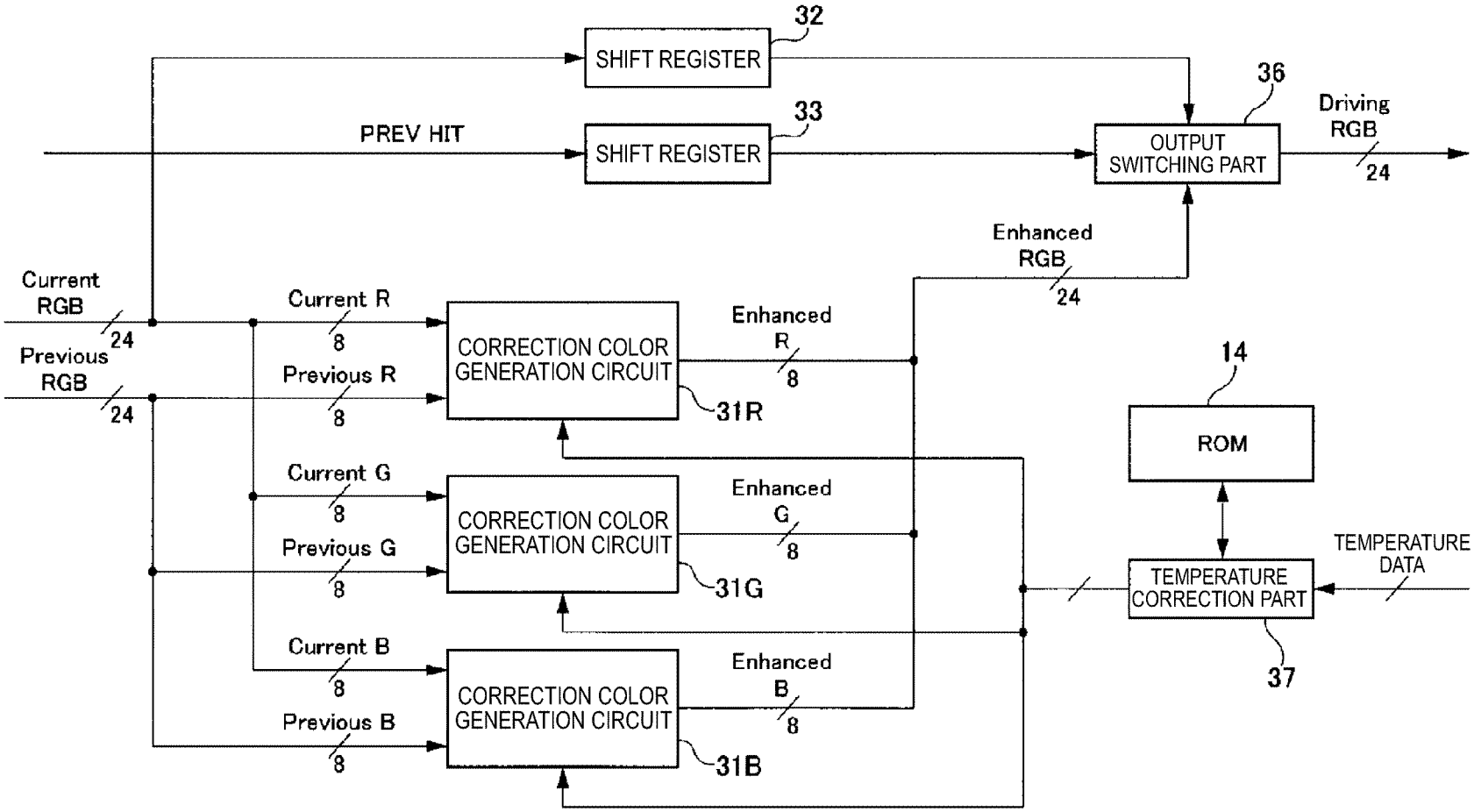
FIG. 4 is a block diagram illustrating an example of a correction processing part according to the first embodiment of the present disclosure.
Figure 7:
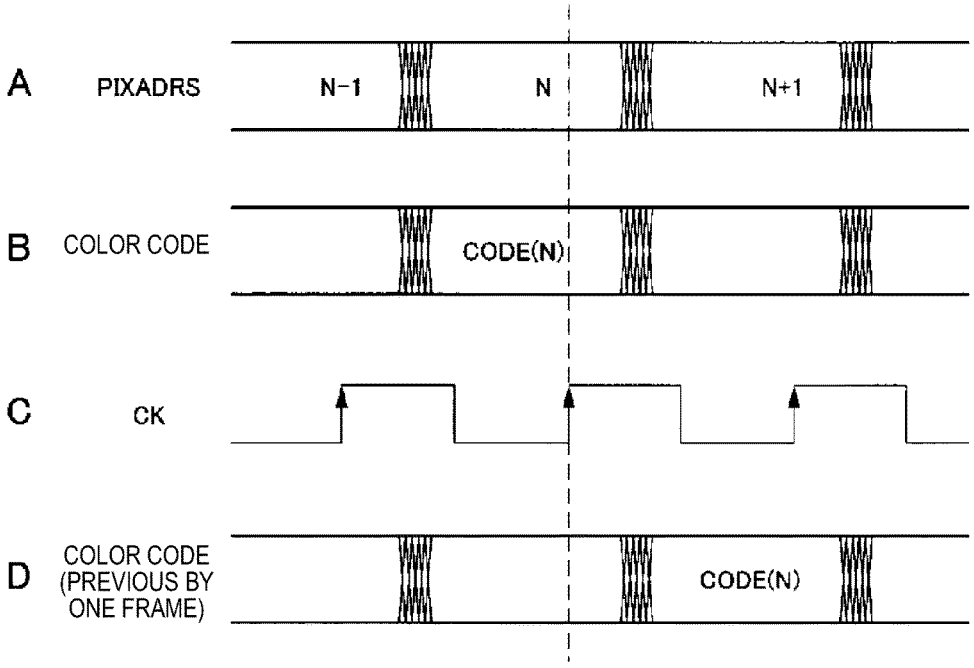
FIGS. 7A to 7D illustrate a timing chart illustrating an example of operation of the frame memory according to the first embodiment of the present disclosure.

1-3. Correction Processing Part According to First Embodiment (FIG. 4)

1-4. Operation Example According to First Embodiment (FIG. 5 to FIGS. 7A to 7D)

Figure 8:
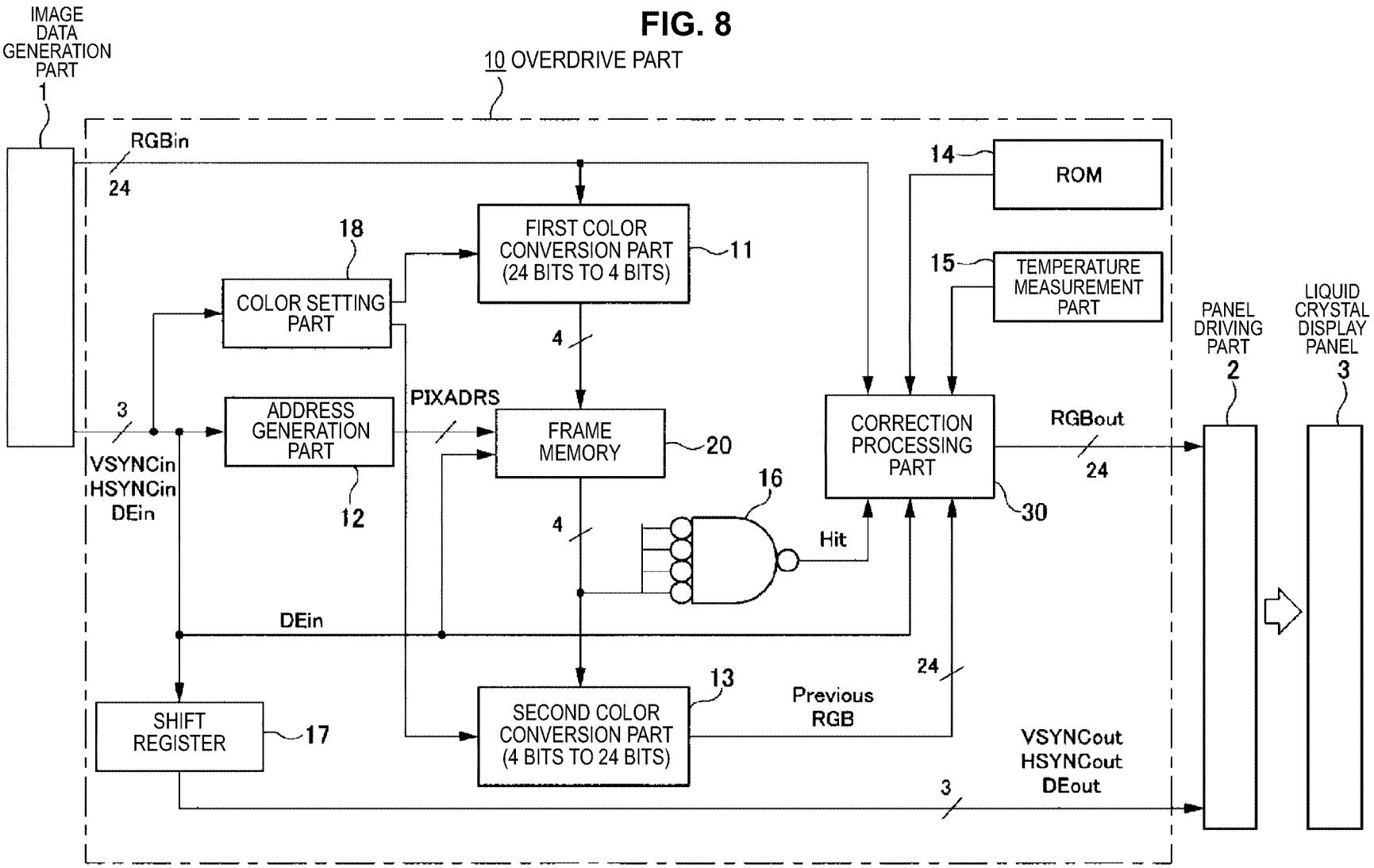
FIG. 8 is a block diagram illustrating a configuration of a variation according to the first embodiment of the present disclosure (example of changing colors variably)

1-5. Variation: Example of Changing Colors Variably (FIG. 8)

Figure 9:
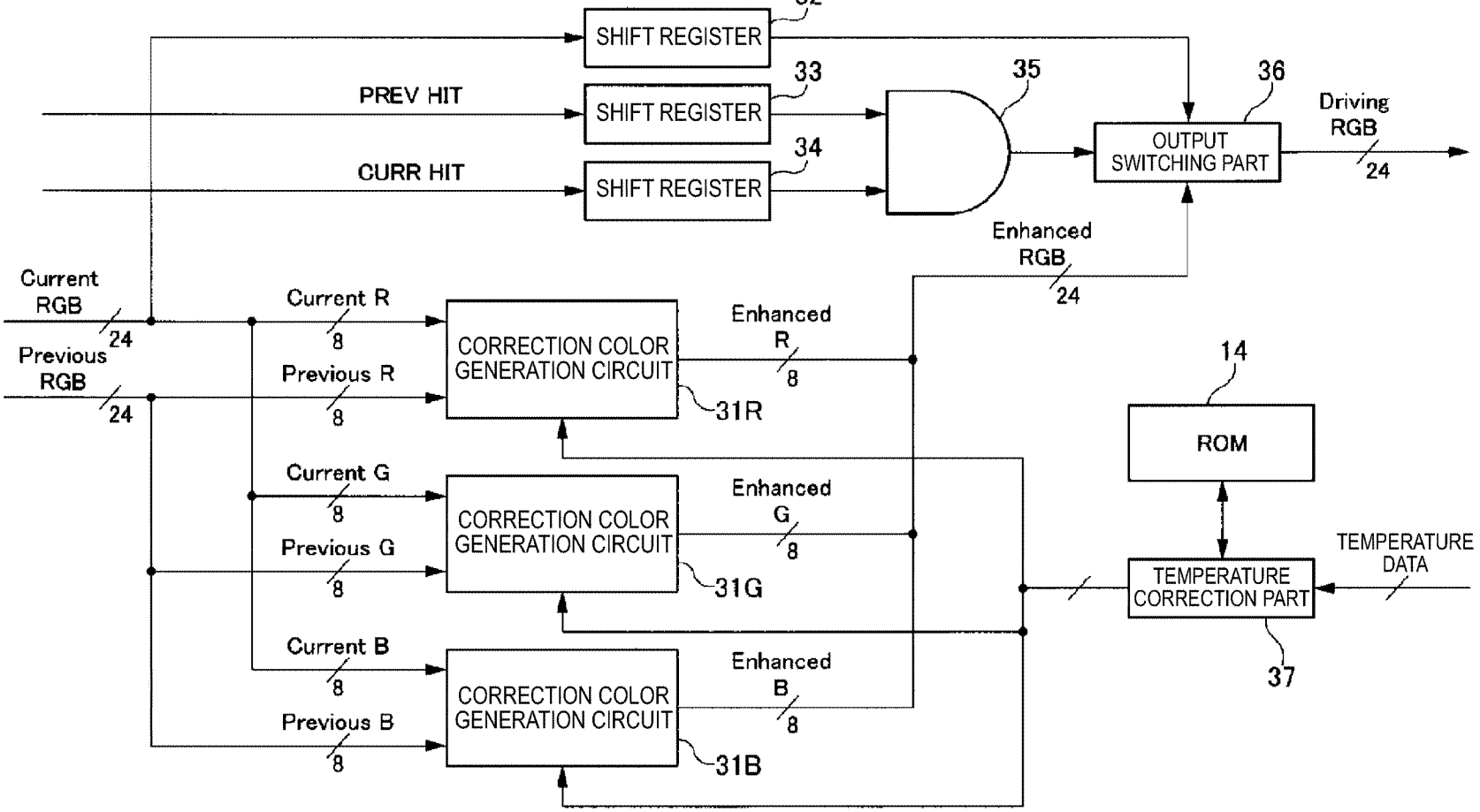
FIG. 9 is a block diagram illustrating a configuration of a variation according to the first embodiment of the present disclosure (example of another condition of performing correction)

1-6. Variation: Example of Another Condition of Performing Correction (FIG. 9)

Figure 10:
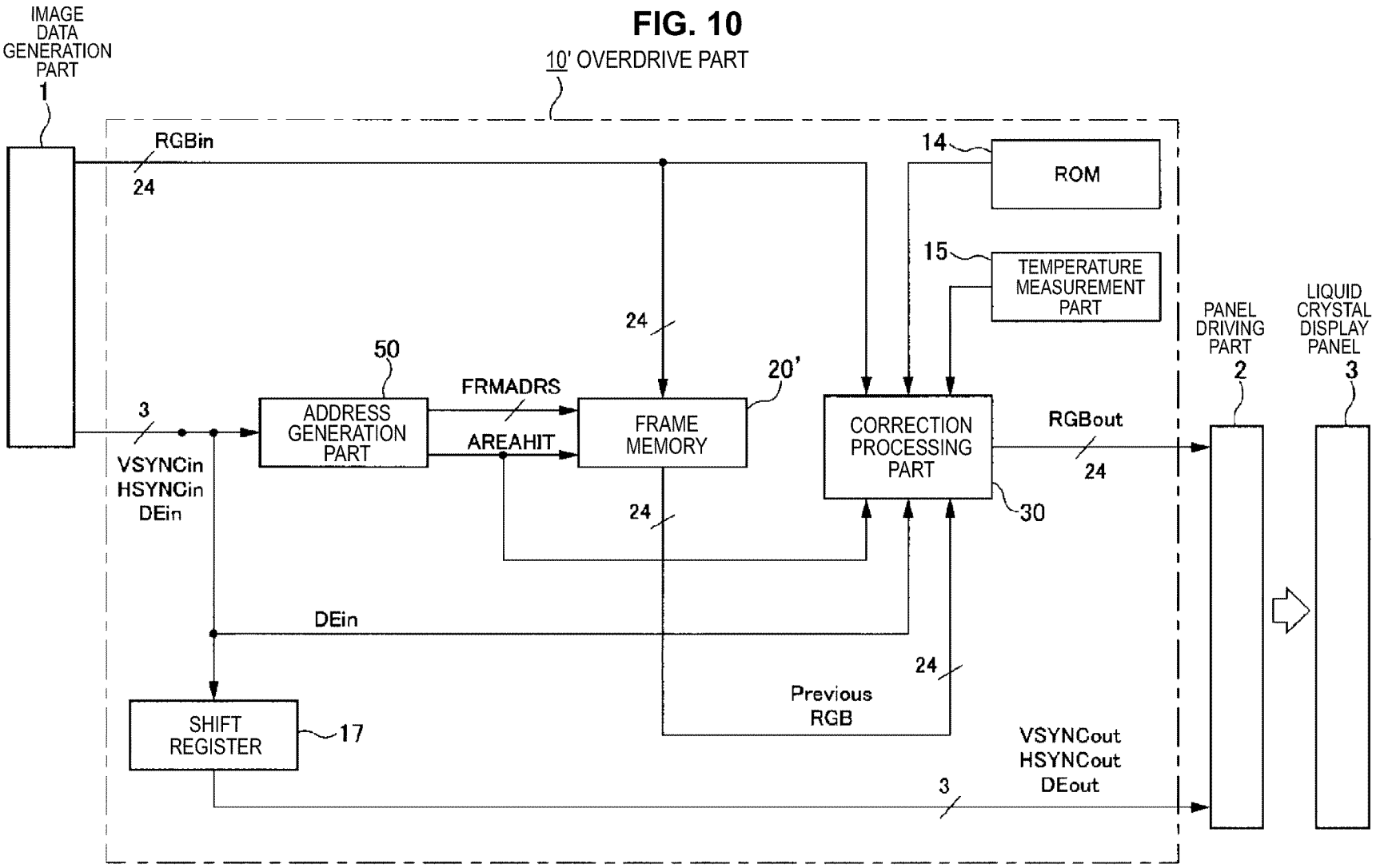
FIG. 10 is a block diagram illustrating an entire exemplary configuration according to a second embodiment of the present disclosure.

2-1. Entire Configuration According to Second Embodiment (FIG. 10)

Figure 11:
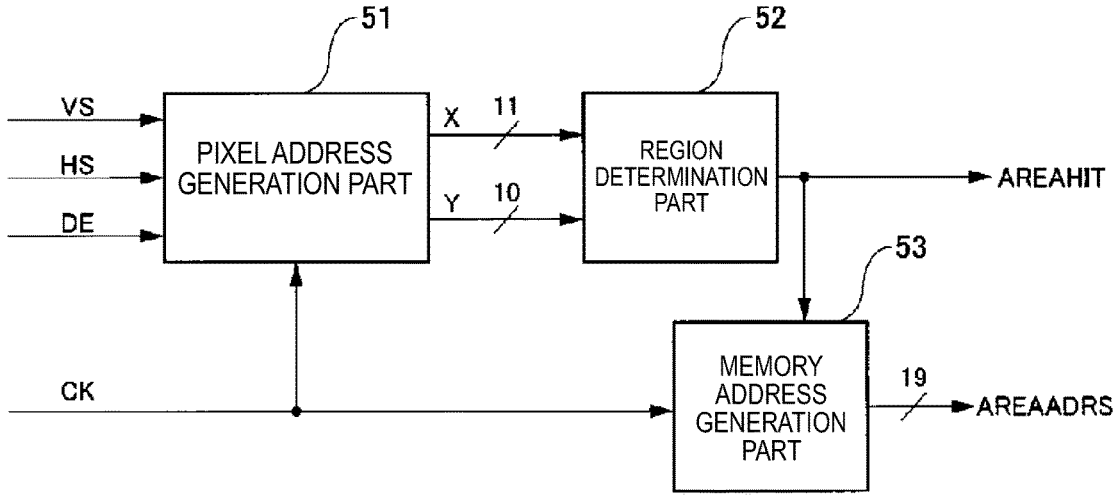
FIG. 11 is a block diagram illustrating an example of an address generation part according to the second embodiment of the present disclosure.

2-2. Address Generation Part According to Second Embodiment (FIG. 11)

Figure 12:
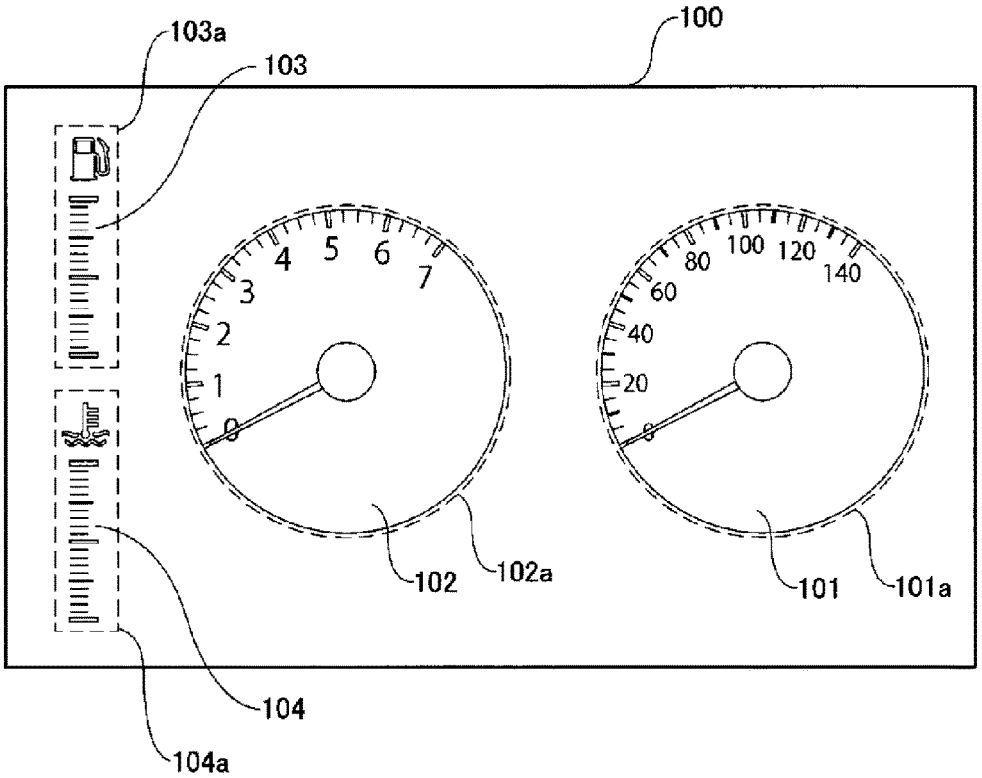
FIG. 12 is a diagram illustrating an example of display according to the second embodiment of the present disclosure.

2-3. Display Example According to Second Embodiment (FIG. 12)

Figure 13:
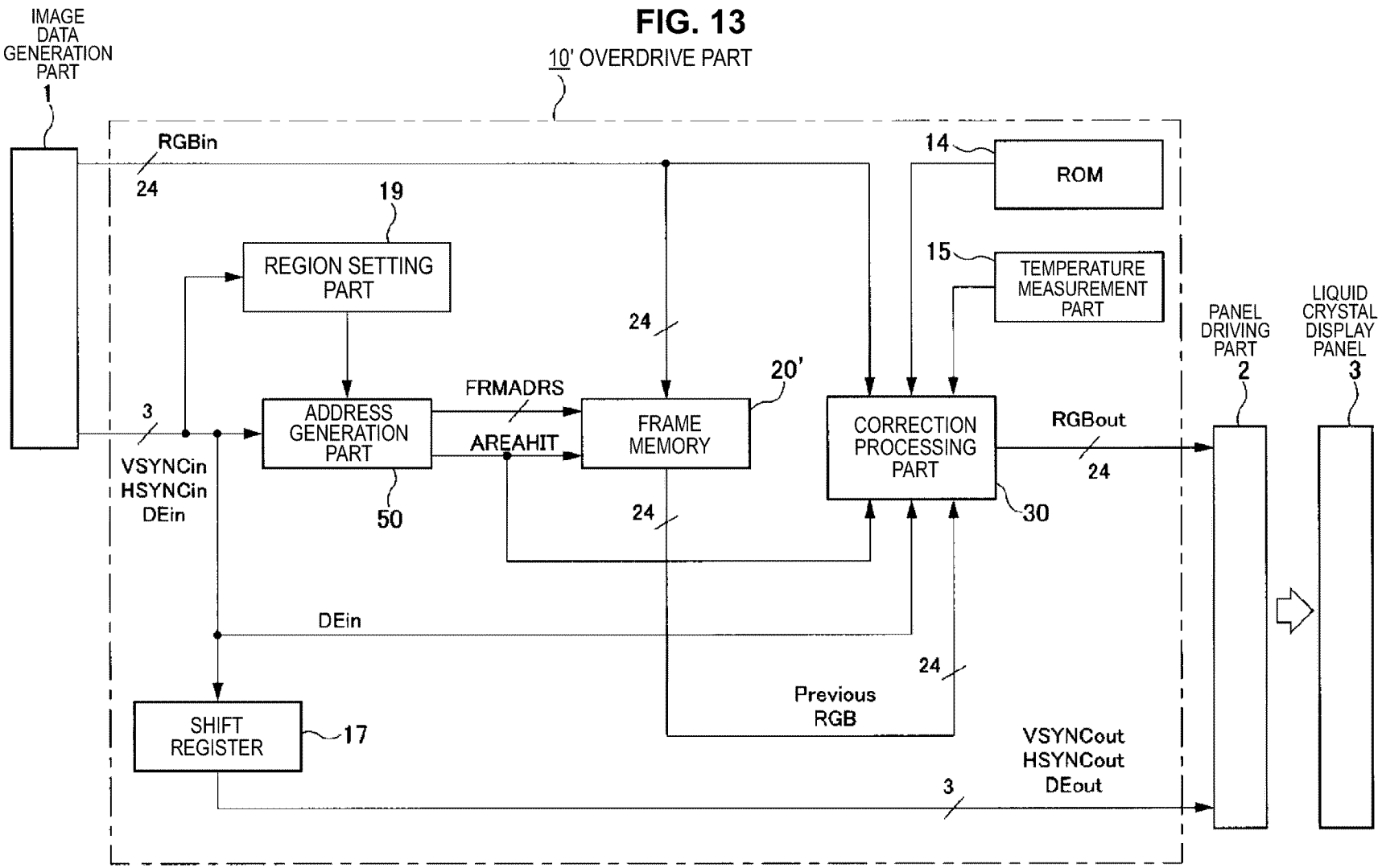
FIG. 13 is a block diagram illustrating a configuration of a variation according to the second embodiment of the present disclosure.

2-4. Variation: Example of Changing Regions Variably (FIG. 13)

3. Other Variations

[1-1. Entire Configuration According to First Embodiment]

FIG. 1 is a diagram illustrating an entire exemplary configuration of a display system according to a first embodiment of the present disclosure.

An image data generation part 1 generates image data displayed by a liquid crystal display panel 3. For example, the image data generation part 1 generates image data such as a map image for a car navigation apparatus. In addition, the image data generation part 1 performs drawing processing of the map image only using beforehand configured specific kinds of colors which are 15 colors at most, and generates the image data. When the image data generation part 1 performs drawing for one other than the map image, the image data may include ones other than the specific kinds of colors.

The image data generated by the image data generation part 1 has, for example, a frame cycle of 1/60 sec. Moreover, data for every one pixel in one frame has totally 24 bits constituted of every 8 bits for each color of red R, green G and blue B. Moreover, the image data generation part 1 outputs vertical synchronization data VSYNC, horizontal synchronization data HSYNC and effective pixel period data DE.

The vertical synchronization data VSYNC is, as illustrated in FIG. 2A, data changing at the head of one frame. The horizontal synchronization data HSYNC is, as illustrated in FIG. 2B, data indicating the horizontal lines in each frame. The effective pixel period data DE is, as illustrated in FIG. 2C, data indicating the section in which effective pixel data is arranged within each horizontal line.

In addition, when the "pixel data" is referred to in the following description, it indicates 24-bit data designating a color for every single pixel. Furthermore, when the "image data" is referred to, it indicates the whole data transmitted in a form of an array of the pixel data with a frame structure.

The image data and synchronization data output by the image data generation part 1 are supplied to an overdrive part 10. The overdrive part 10 is an image data processing circuit which monitors tone change of each pixel, and when the tone change can cause an afterimage, performs processing of correcting the tone of the relevant pixel. The overdrive part 10 is constituted, for example, of one integrated circuit. In this case, a frame memory 20 included in the overdrive part 10 is also built in the integrated circuit.

The overdrive part 10 includes the frame memory 20 and a correction processing part 30. The frame memory 20 stores pixel data converted by a first color conversion part 11 and reads out the stored pixel data in timing of a delay by one frame period. The pixel data read out from the frame memory 20 is supplied to a second color conversion part 13. The writing and readout of the pixel data in the frame memory 20 are controlled based on pixel address data supplied from an address generation part 12.

The first color conversion part 11 converts 24-bit pixel data of one pixel constituted of every 8 bits for each color of red R, green G and blue B into 4-bit color code data. Namely, the first color conversion part 11 assigns 15 values other than a specific value (for example, 0000) out of the 16 values expressed by 4 bits to beforehand configured 15 kinds of colors. The 15 kinds of colors are 15 kinds of colors which the image data generation part 1 uses for drawing processing of the map image. Then, when the pixel data supplied to the first color conversion part 11 is any of the beforehand configured 15 kinds of colors, the first color conversion part 11 outputs the 4-bit color code data that is assigned to the kind of color. Moreover, when the pixel data is a value other than the 15 kinds of colors, the first color conversion part 11 outputs the 4-bit data of value 0000.

The 4-bit color code data for every single pixel output by the first color conversion part 11 is supplied to the frame memory 20. The frame memory 20 stores the 4-bit color code data for every single pixel for one frame, and reads out the stored color code data with a delay by one frame period (1/60 sec).

The color code data read out by the frame memory 20 is supplied to the second color conversion part 13. The second color conversion part 13 converts data of 15 kinds of colors indicated by the 4-bit color code data into original 24-bit pixel data. At this stage, when the 4-bit color code data supplied to the second color conversion part 13 is the 4-bit data of value 0000 indicating one other than the 15 kinds of colors, it does conversion into data with a specific value (for example, the 24-bit data of all zeros).

The 24-bit pixel data output by the second color conversion part 13 is supplied to the correction processing part 30 as pixel data previous by one frame.

Then, 24-bit pixel data in the current frame supplied from the image data generation part 1 to the overdrive part 10 is supplied to the correction processing part 30.

Moreover, the 4-bit color code data read out by the frame memory 20 is supplied to an OR circuit 16 and a 1-bit hit signal HIT is generated by addition. The hit signal HIT is value 1 when any one bit in the 4-bit color code data is value 1, and value 0 when the 4-bit color code data is the 4-bit data of value 0000 indicating the one other than 15 kinds of colors. The hit signal HIT generated by the OR circuit 16 is supplied to the correction processing part 30.

The correction processing part 30 is a circuit performing correction processing for overdrive in order to attain afterimage suppression. However, the correction processing part 30 performs correction processing on pixel data in timing of the hit signal HIT being value 1. In timing of the hit signal HIT being value 0, the correction processing part 30 does not correct 24-bit pixel data supplied from the image data generation part 1 to output as it is.

To the correction processing part 30, a ROM 14 storing data for correction as a correction table and a temperature measurement part 15 are connected. In this case, the ROM 14 stores correction values in case of tone change of the above-mentioned 15 kinds of colors indicated by the 4-bit color code data to other colors.

Then, referring to the correction data stored by the ROM 14, the correction processing part 30 performs correction processing. Moreover, when the correction processing part 30 performs correction processing, compensation processing of temperature characteristics is performed based on temperature data measured by the temperature measurement part 15. In addition, a configuration of the correction processing part 30 is described later.

Then, the image data corrected on a pixel-by-pixel basis is supplied from the correction processing part 30 in the overdrive part 10 to the display panel driving part 2. Moreover, the synchronization data are supplied from the overdrive part 10 to a display panel driving part 2. In this case, the overdrive part 10 includes a shift register 17 delaying the synchronization data, so that the image data supplied to the display panel driving part 2 is coincident with the synchronization data in timing thereof.

[1-2. Frame Memory Configuration According to First Embodiment]

FIG. 3 is a diagram illustrating an exemplary configuration of the frame memory 20.

The frame memory 20 includes a decoder 21 and a RAM 22 storing data. The RAM 22 stores 4-bit color code data obtained in a writing port 23. Then, the color code data read out from the RAM 22 is supplied from a readout port 24 to the second color conversion part 13 and OR circuit 16.

To the decoder 21, a pixel address PIXADRS is supplied from the address generation part 12. Based on the pixel address PIXADRS, the decoder 21 generates a writing address and a readout address to the RAM 22. The writing address and readout address generated by the decoder 21 are supplied to the RAM 22.

The RAM 22 stores data obtained in the writing port 23 at the address position designated by the writing address. Moreover, the RAM 22 reads out the stored data previous by one frame at the address position designated by the readout address, and the stored data is output from the readout port 24.

In addition, to the frame memory 20, a clock CK and an enable signal EN are supplied. The enable signal EN is a signal indicating that writing and readout operations of color code data are effective.

[1-3. Correction Processing Part According to First Embodiment]

FIG. 4 is a diagram illustrating an exemplary configuration of the correction processing part 30.

To the correction processing part 30, 24-bit pixel data CurrentRGB in the current frame and 24-bit pixel data PreviousRGB previous by one frame are supplied. The 24-bit pixel data PreviousRGB previous by one frame is pixel data output by the second color conversion part 13.

Each color component for every 8 bits in the 24-bit pixel data CurrentRGB and PreviousRGB is supplied to a correction color generation circuit 31R, 31G or 31B for the corresponding color component.

Namely, 8-bit red data CurrentR in the current frame and 8-bit red data PreviousR previous by one frame are supplied to the correction color generation circuit 31R for red. Moreover, 8-bit green data CurrentG in the current frame and 8-bit green data PreviousG previous by one frame are supplied to the correction color generation circuit 31G for green. Furthermore, 8-bit blue data CurrentB in the current frame and 8-bit blue data PreviousB previous by one frame are supplied to the correction color generation circuit 31B for blue.

Referring to data of the correction table stored by the ROM 14, each of the correction color generation circuits 31R, 31G and 31B performs correction to a tone indicated by the correction table when tone difference between the individual colors in the current frame and previous by one frame is in predetermined status. However, the correction tone values store by the ROM 14 are configured to be supplied to the individual correction color generation circuits 31R, 31G and 31B after correction based on temperature data by a temperature correction part 37. The temperature data used for the correction by the temperature correction part 37 is data indicating the temperature of the liquid crystal display panel 3 which is measured by the temperature measurement part 15 illustrated in FIG. 1. The temperature correction part 37 performs temperature correction by a mechanism of an operation using a beforehand prepared calculation formula. Or the temperature correction part 37 may perform the temperature correction using data for temperature correction stored by the ROM 14.

As above, the individual correction color generation circuits 31R, 31G and 31B perform overdrive processing for afterimage suppression. When the correction color generation circuits 31R, 31G and 31B are not expected to perform the correction, the supplied 8-bit pixel data are output as they are.

Corrected pixel data EnhancedRGB with 24 bits of 3×8 bits output by the individual correction color generation circuits 31R, 31G and 31B is supplied to an output switching part 36. To the output switching part 36, the 24-bit pixel data CurrentRGB in the current frame and the corrected pixel data EnhancedRGB are supplied. Moreover, a hit signal previous by one frame is supplied to the output switching part 36. Switching of the output switching part 36 is controlled based on the hit signal PreviousHIT. In addition, the pixel data CurrentRGB in the current frame and the hit signal PreviousHIT previous by one frame are adjusted by shift registers 32 and 33 delaying them, respectively, so as to be coincident with each other in timing of those.

When the hit signal PreviousHIT is value 1, the output switching part 36 selects the corrected pixel data EnhancedRGB to output, and when the hit signal PreviousHIT is value 0, it selects the 24-bit pixel data CurrentRGB in the current frame to output. In other words, when the pixel data is data of a color to which any color of the beforehand configured specific 15 colors changes, the output switching part 36 performs operation of selecting the corrected pixel data EnhancedRGB. Meanwhile, when the pixel data is other than colors to which the beforehand configured specific 15 colors change, the output switching part 36 does not perform correction operation and outputs the 24-bit pixel data CurrentRGB in the current frame as it is.

Pixel data DrivingRGB selected and output by the output switching part 36 is supplied to the display panel driving part 2 illustrated in FIG. 1.

[1-4. Operation Example According to First Embodiment]

Next, an operation example according to the first embodiment is described with reference to FIG. 5 to FIGS. 7A to 7D.

FIG. 5 is a diagram illustrating an example of correspondence between 24-bit pixel data converted by the first color conversion part 11 and 4-bit color codes. In FIG. 5, 24-bit pixel data are expressed as hexadecimal and pixel data X represents no storage of corresponding color code data.

As illustrated in FIG. 5, in conversion correspondence data referred to by the first color conversion part 11, only when the 24-bit pixel data is any of the specific 15 kinds, the corresponding 4-bit color code data is present. In case of a color out of the specific 15 kinds of those, the first color conversion part 11 outputs the corresponding color code data. In case of other pixel data (pixel data X illustrated in FIG. 5) input in the first color conversion part 11, the first color conversion part 11 outputs 4-bit data of value 0000.

Such conversion operation of the image data is performed for all the pixels in one frame.

FIG. 6 is a diagram illustrating an example of pixel addresses. For example, in case of 1920 pixels in the horizontal direction×1080 pixels in the vertical direction, individual addresses from 0 to 2073599 are set in the order from the top left to the bottom right of one frame.

The pixel addresses in FIG. 6 are supplied to the decoder 21 of the frame memory 20 in FIG. 3 and color code data at the individual pixel addresses are stored in corresponding memory regions in the RAM 22.

FIGS. 7A to 7D illustrate a timing chart representing operation of the frame memory 20.

As illustrated in FIG. 7A, it is supposed that the pixel address PIXADRS is address N in specific timing. The pixel address continuously changes as address N−1, N, N+1, . . . , synchronizing with a pixel clock CK illustrated in FIG. 7C.

Then, as illustrated in FIG. 7B, the frame memory 20 stores, in timing of pixel address N, color code[CODE(N)] in the current frame at pixel address N input in the writing port 23. Moreover, as illustrated in FIG. 7D, simultaneously at this stage, the frame memory 20 outputs color code [CODE(N)] previous by one frame at pixel address N from the readout port 24.

As above, the frame memory 20 continuously performs storing and readout of the color code data for all the pixels in one frame.

Thus, the frame memory 20 stores data for each pixel as color code data which is formed in 4 bits, and thereby, the frame memory 20 in the overdrive part 10 can exceedingly reduce a storage capacity. Namely, the storage capacity of the frame memory is ⅙ compared with a case where 24-bit pixel data are stored as they are.

Accordingly, the overdrive part 10 can be configured of a circuit with a simple configuration using a memory with a reduced storage capacity. Moreover, reduction of the storage capacity of the frame memory 20 facilitates a configuration in which the frame memory 20 is built in an integrated circuit into which the overdrive part 10 is integrated. When an existing large capacity frame memory is expected, the frame memory should be provided outside the integrated circuit, whereas it can be built in the integrated circuit relatively easily in the case according to the embodiment of the present disclosure. The frame memory 20 is built in the overdrive part 10 which is integrated into a circuit, and thereby, wiring transmitting data to the memory at a high speed is not drawn outside the integrated circuit. Therefore, the overdrive part 10 which is integrated into a circuit is almost released from possibility of undesired radiation to the outside, this attaining excellent characteristics thereof.

In addition, apparent from the description of the correction processing part 30 in FIG. 4, the correction processing part 30 according to the embodiment of the present disclosure performs the overdrive processing for afterimage suppression only when the pixel data is data of any color of the beforehand configured specific 15 colors. Herein, the display system according to the embodiment of the present disclosure is a navigation apparatus displaying a map image and the image data generation part 1 generates image data for displaying the map image in which display colors are limited to 15 colors. Therefore, the overdrive part 10 only has to perform overdrive processing for limited 15 colors, this preventing an afterimage from arising in the map image displayed by the liquid crystal display panel 3.

When the liquid crystal display panel 3 displays colors other than the beforehand configured 15 colors, although the overdrive processing for afterimage suppression is not performed, there is less possibility that the image moves fast when the navigation apparatus displays one other than the map image. For example, there is supposed cases of displaying various kinds of setting screens or displaying in other modes when the display system for a navigation apparatus displays images other than the map. Since these display screens include guidance images including characters and/or still images, an afterimage rarely stands out even in displaying without correction for afterimage suppression.

Since the correction processing part 30 in FIG. 4 yet performs the overdrive processing for afterimage suppression also when the beforehand configured 15 colors change to other colors, this enabling to attain the afterimage suppression excellent. For example, the afterimage suppression is performed also in case of an image in which an object with a specific color selected from the beforehand configured 15 colors (for example, a needle on a meter or the like) is drawn on a background in which colors change delicately with gradation.

[1-5. Variation: Example of Changing Colors Variably]

FIG. 8 is a diagram illustrating a variation of the display system according to the first embodiment of the present disclosure.

In case of the example of FIG. 8, 15 colors for which the overdrive part 10 performs overdrive processing can be set variably according to instruction from the outside.

Namely, as illustrated in FIG. 8, the overdrive part 10 includes a color setting part 18. The color setting part 18 detects color setting data added to the synchronization data (any of the vertical synchronization data VSYNC, horizontal synchronization data HSYNC and effective pixel period data DE) supplied from the image data generation part 1.

At this stage, for example, when the vertical synchronization data VSYNC is at the low level "L", the effective pixel period data DE is made ineffective regarding display image control. Then, during a period of the ineffectiveness, color setting data transmitted in 1-bit serial communication such as UART (Universal Asynchronous Receiver Transmitter) communication using the effective pixel period data DE is detected.

Then, when color change is instructed by the color setting data detected by the color setting part 18, the color setting part 18 instructs change of correspondence between the pixel data and color code data to the first color conversion part 11 and second color conversion part 13.

The other portions in FIG. 8 are configured similarly to those of the display system illustrated in FIG. 1.

As illustrated in FIG. 8, correspondence between the pixel data and color codes which the first color conversion part 11 and second color conversion part 13 convert can be changed, this enabling to freely change combinations of 15 colors on which the overdrive part 10 performs the overdrive processing.

For example, the map image displayed by the navigation apparatus differs between a map displayed in the daytime and a map displayed in the night in color scheme. Therefore, when the image data generation part 1 generates map image data for the daytime, the color setting data which the image data generation part 1 adds to the synchronization data designates color settings for 15 colors constituting the map image data for the daytime. Moreover, when the image data generation part 1 generates map image data for the night, the color setting data which the image data generation part 1 adds to the synchronization data designates color settings for 15 colors constituting the map image data for the night.

As above, a combination of 15 colors undergoing the overdrive processing can be set variably, this enabling the overdrive part 10 to handle various kinds of combinations of display colors. In addition, it is only one example that the color setting data is added to the synchronization data and the color setting data may be received by the overdrive part 10 from the outside in any other way. For example, the image data generation part 1 may perform addition of the color setting data during an ineffective period of image data (pixel data) (period in which pixel data to be displayed is not included).

[1-6. Variation: Example of Another Condition of Performing Correction]

FIG. 9 is a diagram illustrating a variation of the display system according to the first embodiment of the present disclosure.

In the example of FIG. 9, the condition in which the correction processing part 30 in the overdrive part 10 performs the correction is changed from the example of FIG. 4. In the example of FIG. 4, the condition in which the output switching part 36 selects the corrected pixel data EnhancedRGB is the hit signal PreviousHIT previous by one frame which signal indicates the case of any color data of the specific 15 colors.

On the contrary, in the example of FIG. 9, the hit signal PreviousHIT previous by one frame and a hit signal CurrentHIT in the current frame are obtained. Then, the hit signal CurrentHIT in the current frame and the hit signal PreviousHIT previous by one frame are supplied to an AND circuit 35. The switching part 36 is controlled according to the hit signal obtained by the addition in the AND circuit 35. In addition, the pixel data CurrentRGB in the current frame, the hit signal PreviousHIT previous by one frame and the hit signal CurrentHIT in the current frame are adjusted by shift registers 32, 33 and 34 delaying them, respectively, sol as to be coincident with one another in timing of those.

When both of the hit signals are value 1 and coincident with each other, the output switching part 36 selects the corrected pixel data EnhancedRGB to output, and when any of the hit signals is value 0, it selects the 24-bit pixel data CurrentRGB in the current frame to output. The other portions in FIG. 9 are configured similarly to those of the correction processing part 30 illustrated in FIG. 4.

According to the configuration illustrated in FIG. 9, when the pixel data changes among data of any colors of the beforehand configured specific 15 colors, the output switching part 36 selects the corrected pixel data EnhancedRGB. Meanwhile, when the pixel data is other than the beforehand configured specific 15 colors, the output switching part 36 outputs the 24-bit pixel data CurrentRGB in the current frame as it is. Accordingly, for example, only when display colors are limited to the specific 15 colors, the correction operation is performed.

[2-1. Entire Configuration According to Second Embodiment]

Next, an example of a second embodiment according to the embodiment of the present disclosure is described.

FIG. 10 is a diagram illustrating an entire exemplary configuration of the display system according to the second embodiment of the present disclosure.

In FIG. 10, portions corresponding to those in FIG. 1 to FIG. 9 described for the first embodiment are provided with the same reference numerals.

The image data generation part 1 illustrated in FIG. 10 generates, for example, an image data for a meter panel used for a vehicle (car). The image data output by the image data generation part 1 and the synchronization data are similar data to the data in the forms described for the examples according to the first embodiment. Namely, the image data has one frame period of 1/60 sec and the pixel data for one pixel is 24-bit data.

The image data and synchronization data output by the image data generation part 1 is supplied to an overdrive part 10'. The overdrive part 10' is an image data processing circuit performing processing of correction to suppress an afterimage of each pixel. The overdrive part 10' in the example of FIG. 10 is also constituted, for example, of one integrated circuit. A frame memory 20' included in the overdrive part 10 is built in the integrated circuit.

The overdrive part 10' includes the frame memory 20' and the correction processing part 30. The frame memory 20' stores pixel data supplied from the image data generation part 1 and reads out the stored pixel data in timing of a delay by one frame period. However, the frame memory 20' only stores pixels within a beforehand configured specific region (image range) out of the pixels in one frame. The writing and readout of the pixel data in the frame memory 20' are controlled based on pixel address data supplied from an address generation part 50. A configuration of the address generation part 50 is described later.

The frame memory 20' stores the pixel data in the specific region (image range) for one frame, and reads out the stored pixel data delayed by one frame period (1/60 sec). The data for one pixel stored by the frame memory 20' is 24-bit data constituted of every 8 bits for each color of red R, green G and blue B.

The pixel data read out by the frame memory 20' is supplied to the correction processing part 30 as pixel data previous by one frame.

Then, the 24-bit pixel data in the current frame supplied from the image data generation part 1 to the overdrive part 10' is supplied to the correction processing part 30.

The correction processing part 30 is a circuit performing correction processing for overdrive in order to attain afterimage suppression. However, the correction processing part 30 performs the correction processing only on the pixel data in timing of the region hit signal AREAHIT supplied from the address generation part 50 being value 1. Then, the pixel data in timing of the region hit signal AREAHIT being value 0 is output as it is, the 24-bit pixel data supplied from the image data generation part 1 not being corrected. Such processing can be realized by the output switching part 36 illustrated in FIG. 4 performing switching based on the region hit signal AREAHIT.

To the correction processing part 30, a ROM 14' storing data for correction as a correction table and the temperature measurement part 15 are connected. The ROM 14' in this case stores a correction value upon tone change of each color of the pixel data.

The correction processing part 30 performs the correction processing, referring to the correction data stored by the ROM 14'. When the correction processing part 30 performs the correction processing, compensation processing on temperature characteristics is performed based on the temperature data measure by the temperature measurement part 15.

Then, the image data corrected on a pixel-by-pixel basis is supplied from the correction processing part 30 in the overdrive part 10' to the display panel driving part 2. Moreover, the synchronization data is supplied from the overdrive part 10' to the display panel driving part 2. In this case, the overdrive part 10' includes the shift register 17 delaying the synchronization data, so that the image data and synchronization data supplied to the display panel driving part 2 are coincident with each other in timing thereof.

Then, the display panel driving part 2 drives image display on the liquid crystal display panel 3.

[2-2. Address Generation Part According to Second Embodiment]

FIG. 11 is a diagram illustrating a configuration of the address generation part 50.

The address generation part 50 includes a pixel address generation part 51 to which the synchronization data output by the image data generation part 1 (vertical synchronization data VSYNC, horizontal synchronization data HSYNC and effective pixel period data DE) are supplied. The pixel address generation part 51 generated pixel address X in the horizontal direction and pixel address Y in the vertical direction, based on these synchronization data.

The pixel addresses X and Y output by the pixel address generation part 51 are supplied to a region determination part 52. The region determination part 52 determines whether or not the pixel position indicated by the pixel addresses is within a region where the correction for afterimage suppression is performed in the overdrive part 10'. Then, based on the determination, the region determination part 52 generates the region hit signal AREAHIT. The region hit signal AREAHIT is a signal being value 1 in case of the region for performing the correction for afterimage suppression and being value 0 beyond the region for the correction.

Moreover, the region hit signal AREAHIT and clock CK are supplied to a memory address generation part 53. The memory address generation part 53 generates a storage address AREAADRS of the pixel data written in the frame memory 20'. The storage address AREAADRS generated by the memory address generation part 53 and the region hit signal AREAHIT generated by the region determination part 52 are supplied to the frame memory 20'.

The frame memory 20' writes the pixel data at the address designated by the storage address AREAADRS when the region hit signal AREAHIT is value 1. Moreover, the pixel data written previous by one frame as the address designated by the storage address AREAADRS is read out from the frame memory 20'.

[2-3. Display Example According to Second Embodiment]

According to the display system illustrated in FIG. 10, the frame memory 20' only stores the pixel data within the region which the region determination part 52 determines for the correction for afterimage suppression. Then, the correction processing part 30 performs tone correction only on pixels within the range (image range) for performing the correction for afterimage suppression. Therefore, the frame memory 20' in the overdrive part 10' can reduce the storage capacity corresponding to the size of the region. The effect of the frame memory 20' reducing the storage capacity has been described for the first embodiment.

Herein, a specific example of restricting regions for correction is described.

The liquid crystal display panel 3 included in the display system according to the embodiment of the present disclosure is a meter panel installed in a car. FIG 12 illustrates a display example of the liquid crystal display panel 3 as the meter panel.

As illustrated in FIG. 12, a screen 100 displayed by the liquid crystal display panel 3 includes a speedometer 101 indicating the speed of the vehicle and a tachometer 102 indicating the rotation number of the engine, these indications realized by the positions of needles on the scales. Moreover, the screen 100 displayed by the liquid crystal display panel 3 displays a fuel gauge 103 and a thermometer 104.

When displaying as illustrated in FIG. 12, the ranges where the frame memory 20' in the overdrive part 10' stored the pixel data are set to regions 101*a*, 102*a*, 103*a* and 104*a* in which the meters 101 and 102, fuel gauge 103 and thermometer 104 are displayed.

By doing so, the regions 101*a*, 102*a*, 103*a* and 104*a* in which the meters 101 and 102, fuel gauge 103 and thermometer 104 are displayed are displayed, having undergone the correction for afterimage suppression. For example, even when the needle in the speedometer 101 moves relatively fast, the speedometer 101 in the screen 100 is not subject to an afterimage.

When a region other than the meters 101 and 102, fuel gauge 103 and thermometer 104 displays anything using characters and/or shapes (warning or the like), although such display does not undergo the afterimage correction, the afterimage does not stand out since it does not move fast as the meter displayed does.

[2-4. Variation: Example of Changing Regions Variably]

FIG. 13 is a diagram illustrating a variation of the display system according to the second embodiment of the present disclosure.

In case of the example of FIG. 13, a range undergoing the overdrive processing by the overdrive part 10' can be set variably according to instruction from the outside.

Namely, as illustrated in FIG. 13, the overdrive part 10' includes a region setting part 19. The region setting part 19 detects region setting data added to the synchronization data (any of the vertical synchronization data VSYNC, horizontal synchronization data HSYNC and effective pixel period data DE) supplied from the image data generation part 1.

At this stage, for example, when the vertical synchronization data VSYNC is at the low level "L", the effective pixel period data DE is made ineffective regarding display image control. Then, during a period of the ineffectiveness, region setting data transmitted in 1-bit serial communication such as UART communication using the effective pixel period data DE is detected.

Then, when region change is instructed by the region setting data detected by the region setting part 19, the region setting part 19 instructs change of the region stored by the frame memory 20' to the address generation part 50.

The other portions in FIG. 13 are configured similarly to those of the display system illustrated in FIG. 10.

As illustrated in FIG. 13, the region stored by the frame memory 20' can be changed, this enabling to freely change a range undergoing the overdrive processing by the overdrive part 10'.

Figure 14:
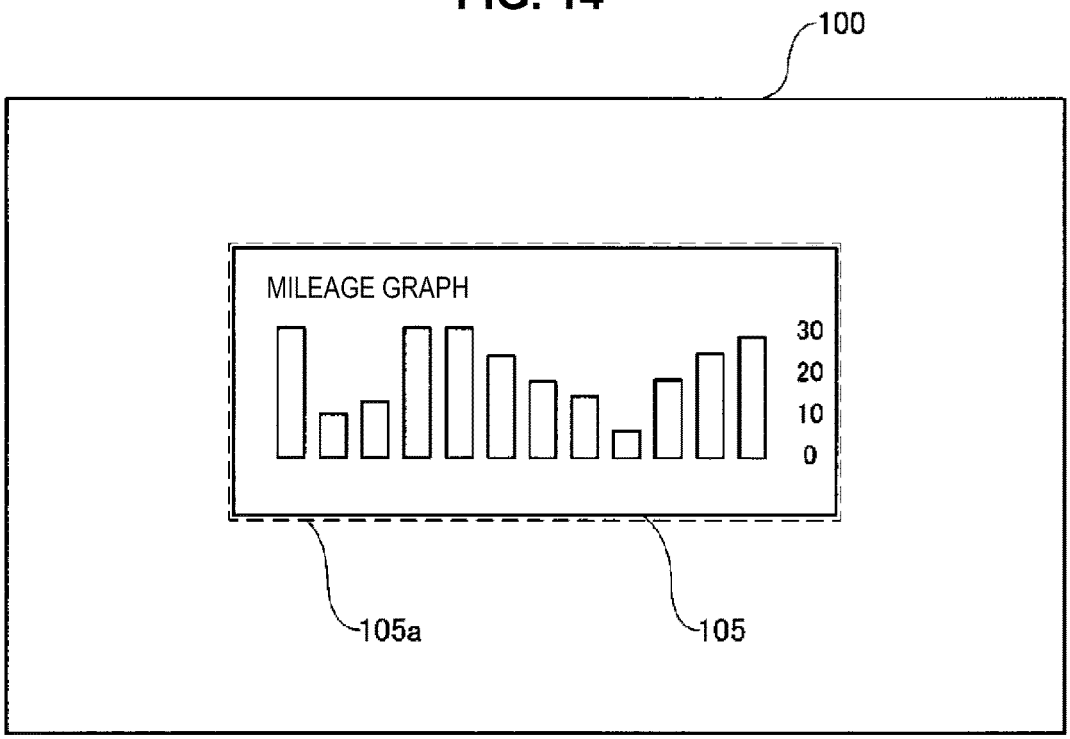
FIG. 14 is a diagram illustrating an example of display in a variation according to the second embodiment of the present disclosure.

For example, in an ordinary mode, the liquid crystal display panel 3 displays the meters 101 and 102 and the like illustrated in FIG. 12. Meanwhile, in a mode of displaying fuel efficiency of the car, the liquid crystal display panel 3 displays a mileage graph 105 in place of the meters 101 and 102 and the like, as illustrated in FIG. 14. At this stage, in displaying the mileage graph 105, the image data generation part 1 instructs change of the range undergoing the overdrive processing to the region setting part 19.

Based on the instruction, the region setting part 19 makes settings such that a range 105*a* in which the mileage graph 105 is displayed undergoes the overdrive processing.

As above, a range undergoing the overdrive processing can be set variably, this enabling the overdrive part 10' to handle various kinds of displaying. In addition, it is only one example that the region setting data is added to the synchronization data and the region setting data may be received by the overdrive part 10' from the outside in any other way. For example, the image data generation part 1 may perform addition of the region setting data during an ineffective period of image data (pixel data) (period in which pixel data to be displayed in not included).

[3. Other Variations]

In addition, in the above-mentioned examples according to the second embodiment, the correction processing part 30 performs the correction processing for overdrive in order to attain afterimage suppression only within a meter display region in the image data for the meter panel. In this case, display colors for the meter display region may be limited only to 15 colors of beforehand configured specific kinds of colors at most. Furthermore, when the frame memory stores the pixel data within the meter display region, as described for the first embodiment, the storage capacity of the frame memory may further be reduced by conversion of each pixel data to a 4-bit color code or the like.

Moreover, it is one example that 24-bit pixel data is converted into 4-bit color code data described for the first embodiment, whereas conversion into color code data with other bit numbers may be applicable. Such a bit number is appropriately selectable according to kinds of colors in drawing a display image.

Furthermore, the car navigation apparatus described for the first embodiment and the meter display panel described for the second embodiment are application examples for embodiments of the display system, whereas the technology according to the embodiment of the present disclosure may be applied to other display systems.

Moreover, the correction processing part 30 described for each example of the embodiments performs the correction processing, preparing the table (ROM 14) storing data for correction and referring to the data in the table, whereas the correction processing part 30 may obtain correction values for pixels by operations using calculation formulae for the operations of the correction values.

Additionally, the present technology may also be configured as below.

(1) An image data processing circuit including:

a memory storing input image data, the input image data being limited to a specific number of colors or to a specific image range; and a correction processing part replacing, when a predetermined tone change is present between a pixel in image data previous by one frame whose data is stored by the memory and a pixel in image data in a current frame whose data is input, a relevant pixel in the current frame with a color of a specific tone, wherein the memory is built in an integrated circuit included in the correction processing part.

(2) The image data processing circuit according to (1), wherein, in limiting a number of colors stored by the memory, a pixel in the input image data includes a limited type of colors.

(3) The image data processing circuit according to (2), further including:

a color setting part setting which color is limited when the memory stores the colors.

(4) The image data processing circuit according to (2) or (3), wherein the color setting part sets the type of colors, based on synchronization data of the image data or control data added to pixel data.

(5) The image data processing circuit according to any one of (1) to (4), further including:

a region setting part setting, in limiting an image range stored by the memory to the specific image range, the specific image range.

(6) The image data processing circuit according to (5), wherein the region setting part sets the specific image range, based on synchronization data of the image data or control data added to pixel data.

(7) An image data processing circuit including:

a memory storing input image data, the input image data being limited to a specific number of colors or to a specific image range; and a correction processing part replacing, when a predetermined tone change is present between a pixel in image data previous by one frame whose data is stored by the memory and a pixel in image data in a current frame whose data is input, a relevant pixel in the current frame with a color of a specific tone.

(8) A display system including:

an image data generation part generating image data for display in a frame cycle;

a memory storing the image data generated by the image data generation part, the image data being limited to a specific number of colors or to a specific image range;

a correction processing part replacing, when a predetermined tone change is present between a pixel in image data previous by one frame whose data is stored by the memory and a pixel in image data in a current frame whose data is generated by the image data generation part, a relevant pixel in the current frame with a color of a specific tone; and a driving part driving a display panel, based on the image data generated by the correction processing part.

It should be understood by those skilled in the art that various modifications, combinations, sub-combinations and alterations may occur depending on design requirements and other factors insofar as they are within the scope of the appended claims or the equivalents thereof.

The present disclosure contains subject matter related to that disclosed in Japanese Priority Patent Application JP 2012-186727 filed in the Japan Patent Office on Aug. 27, 2012, the entire content of which is hereby incorporated by reference.

What is claimed is:

1. An image data processing circuit comprising:

memory configured to store color code data during a previous time period, pixel information is electronically convertible into the color code data prior to the color code data being stored in the memory; a region setting circuitry configured to use synchronization data to set a boundary of an image; and a correction processing circuitry configured to detect a tone difference between previous pixel data and current pixel data, wherein the current pixel data is the pixel information during a current time period, the color code data in the memory is electronically convertible into the previous pixel data during the current time period.

2. The image data processing circuit according to claim 1, wherein the correction processing circuitry is configured to replace a relevant pixel in the current pixel data with a color of a specific tone.

3. The image data processing circuit according to claim 1, wherein the memory is built in an integrated circuit included in the correction processing circuitry.

4. The image data processing circuit according to claim 1, wherein the color code data identifies one of a limited number of colors when the color code data is one of many color codes.

5. The image data processing circuit according to claim 4, wherein the correction processing circuitry is configured to output image data to a panel driving circuitry, the image data is said one of the limited number of colors when the color code data is said one of many color codes.

6. The image data processing circuit according to claim 5, wherein the image data is the current pixel data when the color code data is a non-color code.

7. The image data processing circuit according to claim 6, wherein the color code data identifies a color other than any of the limited number of colors when the color code data is the non-color code.

8. The image data processing circuit according to claim 4, further comprising:

a color setting circuitry that uses the synchronization data to set a color tone associated with the many color codes.

9. The image data processing circuit according to claim 1, further comprising:

a color conversion circuitry configured to electronically convert the pixel information into the color code data prior to the color code data being stored in the memory.

10. The image data processing circuit according to claim 1, further comprising:

a color conversion circuitry configured to electronically convert the color code data in the memory into the previous pixel data.

11. The image data processing circuit according to claim 1, wherein the current time period occurs after the previous time period.

12. The image data processing circuit according to claim 1, wherein the color code data has a first number of bits and the pixel information has a second number of bits.

13. The image data processing circuit according to claim 12, wherein the second number of bits differs from the first number of bits.

14. The image data processing circuit according to claim 12, wherein the previous pixel data has the second number of bits.

15. The image data processing circuit according to claim 12, wherein the first number of bits is less than the second number of bits.

16. A display system comprising:

the image data processing circuit according to according to claim 1;

driving circuitry configured to use enhanced pixel data and the current pixel data to drive a display panel.

* * * * *